United States Patent [19]

Latka

[11] Patent Number: 5,016,683

[45] Date of Patent: May 21, 1991

[54] APPARATUS FOR CONTROLLABLY FEEDING A PARTICULATE MATERIAL

[75] Inventor: Henry C. Latka, Rochester, N.Y.

[73] Assignee: General Signal Corporation, Rochester, N.Y.

[21] Appl. No.: 499,583

[22] Filed: Mar. 27, 1990

[51] Int. Cl.[5] ..... B65B 1/04; B01F 15/02

[52] U.S. Cl. ..... 141/1; 141/31; 141/98; 366/154; 366/176

[58] Field of Search ..... 141/1, 4, 5, 34, 67, 141/98, 250; 222/167, 168.5; 366/154, 187, 196, 245, 324

[56] References Cited

U.S. PATENT DOCUMENTS

| | | | |
|---|---|---|---|
| 1,221,136 | 4/1917 | Boudwin | 222/167 |
| 1,284,700 | 11/1918 | Johnson | 222/129 |
| 1,399,124 | 12/1921 | Johnson et al. | 222/129 |
| 1,553,613 | 9/1925 | Holthoff | 241/171 |
| 2,015,164 | 9/1935 | Thompson | 141/1 |
| 2,962,363 | 11/1960 | Martin | 156/617.1 |
| 2,977,258 | 3/1961 | Dunkle | 156/617.1 |
| 2,998,335 | 1/1957 | Dehmelt | 156/617.1 |
| 3,377,003 | 8/1961 | Bacon et al. | 222/386 |
| 4,249,988 | 4/1968 | Lavigna et al. | 156/605 |
| 4,312,700 | 1/1982 | Helmreich et al. | 156/616 |
| 4,454,096 | 6/1984 | Lorenzini et al. | 422/249 |
| 4,661,324 | 4/1987 | Sink et al. | 422/246 |
| 4,762,687 | 8/1988 | Belouet et al. | 422/253 |

FOREIGN PATENT DOCUMENTS

| | | | |
|---|---|---|---|
| 0170856 | of 0000 | European Pat. Off. . | |
| 0314858 | 10/1988 | European Pat. Off. | 15/2 |

OTHER PUBLICATIONS

Accurate Dry Material Feeders-Weigh Belt Feeders WB T6M 9-88, no date.

Accurate Dry Material Feeders-Food and Pharmaceutical Feeders SAN T2M 6/89, SAN T2M 6/89MET, no date.

Ingenious Mechanisms, vol. 1, Industrial Press Inc., pp. 483-491, 1930.

Ingenious Mechanisms for Designers and Inventors, vol. III, Industrial Press, Inc., pp. 450-461, 1951.

*Primary Examiner*—Henry J. Recla
*Assistant Examiner*—David J. Walczak
*Attorney, Agent, or Firm*—Pollock, Vande Sande & Priddy

[57] ABSTRACT

An apparatus for controllably feeding a particulate material, and particularly silicon material into a crucible, comprises a drum mounted for rotation about an axis tilted at an acute angle with reference to the horizontal. At least one cavity, a portion of which is formed in the inner surface of the bottom wall of the drum, extends from about the outer periphery of the bottom wall at its one end towards the center thereof at its other end. At one of its ends, the cavity communicates with an aperture in the bottom wall. A feeding tube having an outlet port supplies the material into the cavity and is so positioned in relation to the drum that the outlet port directs the material into the cavity only when the cavity is in a rotational position in which its end with the aperture is elevated with respect to a horizontal plane above the other end of the same cavity and pours the material into that portion of the receiving cavity which is remote from the aperture. The flow of the material is interrupted when its level above the cavity reaches a predetermined level. Upon rotation of the drum, the cavity is filled with the material fed from the tube during the rotation of the drum through a first angular portion of its rotation when its aperture is disposed above the already filled portion of the cavity and is emptied to discharge the material by gravity during the rotation of the drum through a second angular portion of its rotation when the aperture is below the filled portion. The feeding rate of the material being discharged is controlled by the rate of rotation of the drum.

22 Claims, 6 Drawing Sheets

APPARATUS FOR CONTROLLABLY FEEDING A PARTICULATE MATERIAL

FIELD OF THE INVENTION

The present invention relates to an apparatus and method for controllably feeding a particulate material. The invention is particularly suitable for use in the replenishment of silicon material in a crystal growing furnace.

BACKGROUND OF THE INVENTION

Different methods and feeding devices are known in the prior art for conveying particulate material at desired feeding rates into machines for further processing. One type of such feeding device incorporates a feeding belt for conveying particulate material at either a constant or a variable feeding rate. Control of the feeding rate in this kind of feeder is accomplished by controlling the speed of the feeding belt. However, the use of belt feeders in applications requiring uniform and accurate feeding rates presents problems. Various factors affecting performance of such feeders include the influence of wear and temperature in stretching or contracting the belt. Also, flexible materials must be used for belts and this limits the available materials. There are also problems regarding the accuracy of the feed rate since it is greatly dependent on the method used in depositing the material onto the belt. Also particulate material being conveyed may spill.

Other types of known feeders employ rotary feeding drums. One such example is a feeding drum disclosed in Boudwin U.S. Pat. No. 1,221,136 in which the feeding apparatus includes a revolvable feeding drum with a lifting vane located within the drum. Also, a structure of a rotatable feeder for conveying material to machines such as mills is disclosed in Holthoff U.S. Pat. No. 1,553,613. In rotary drum feeders, the material feeding rate is controlled by varying the rotational speed of the drum. Use of rotary drum structures has some advantages over belt feeders, including, inter alia, a greater variety of suitable materials for a rigid drum structure, and reduced criticality of mechanical adjustments than is required with belts.

In rotary drum type feeders, on the other hand, various mechanical parts are required, such as lifting vanes, spiral scopes, helical ribs, etc. for lifting and directing the particulate material from the rotary drum to the outlet means. The lifting vanes, helical ribs and other parts of the drum tend to abrade and wear and require maintenance.

There is thus a need in the art for a feeding apparatus with improved feeding accuracy, and a simpler and easier-to-maintain structure.

SUMMARY OF THE INVENTION

It is an object of the present invention to provide an apparatus for controllably feeding particulate material in which the apparatus has a simple structure and a minimum amount of mechanical parts.

It is another object of the present invention to provide a drum structure which is simple and inexpensive to manufacture and easily maintained.

It is another object of the present invention to provide a feeding apparatus which is easily operable, easily controllable and allows for a wide range of control of the feeding rate.

It is still another object to provide a structure of the feeding apparatus which provides a constant material feeding rate, reduced abrasion of the mechanical parts, and therefore, reduced wear and easy maintenance.

The above advantages are achieved by use of the feeding apparatus of the present invention which comprises a drum mounted for rotation about an axis tilted at an acute angle with reference to the horizontal and including a bottom wall and an annular, upstanding wall. In a preferred embodiment, at least one cavity is provided, at least a portion of which is formed in the inner surface of the bottom wall. The cavity extends from about the outer periphery of the bottom wall at one end towards the center thereof at the other end. The cavity at one of its ends communicates with at least one outlet means. Means is provided for supplying the particulate material into the drum cavities.

In a preferred embodiment, the means for supplying the particulate material feeds the material into the cavity while it is in a lowermost position with reference to the horizontal and pours the material into that portion of the cavity which is spaced from said outlet means of the cavity which preferably is located generally adjacent the center of the drum. In this way, the particulate material will, when the drum is rotated to a position in which the substantially filled cavity is rotated to an upper position, flow by gravity from the outlet means which may simply comprise an aperture in the bottom wall of the drum.

Means are provided for interrupting the flow of the particulate material to the cavity when the level of the particulate material in the cavity reaches a predetermined level. Also, means for rotating the drum about the tilted axis and means for controlling its rate of rotation are provided.

Described broadly, the feeding apparatus of this invention operates as follows. Upon rotation of the drum, the one or more cavities are filled with the particulate material fed from the supplying means during the rotation of the drum through a first angular distance. The cavity is emptied by discharging the particulate material through the outlet means by gravity during the rotation of the drum through a second angular distance. The feeding rate of particulate material being discharged through the outlet means is closely proportionate to the rate of rotation of the drum.

Although the present invention apparatus may be used in many different applications requiring feeding of particulate material at a controllable, known feeding rate, it is particularly suitable for use with an apparatus for replenishment of silicon material in a crystal growing furnace.

The present invention will now be described in more detail with reference being made to one preferred embodiment shown in the accompanying drawings, wherein:

DETAILED DESCRIPTION OF THE PREFERRED EMBODIMENT(S)

Figure 1:
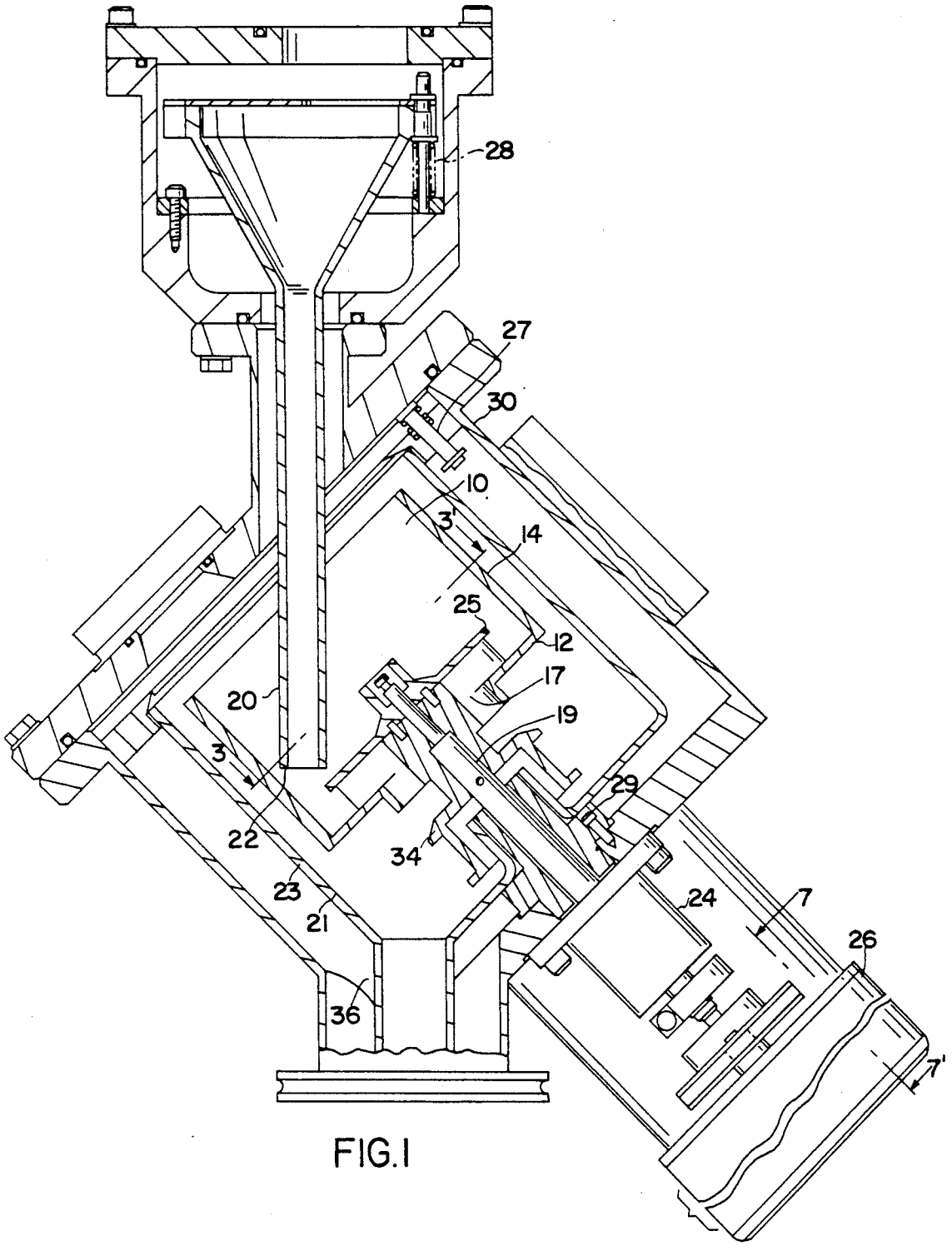
FIG. 1 shows a cross-sectional view of one embodiment of a feeding apparatus according to the present invention.
Figure 3:
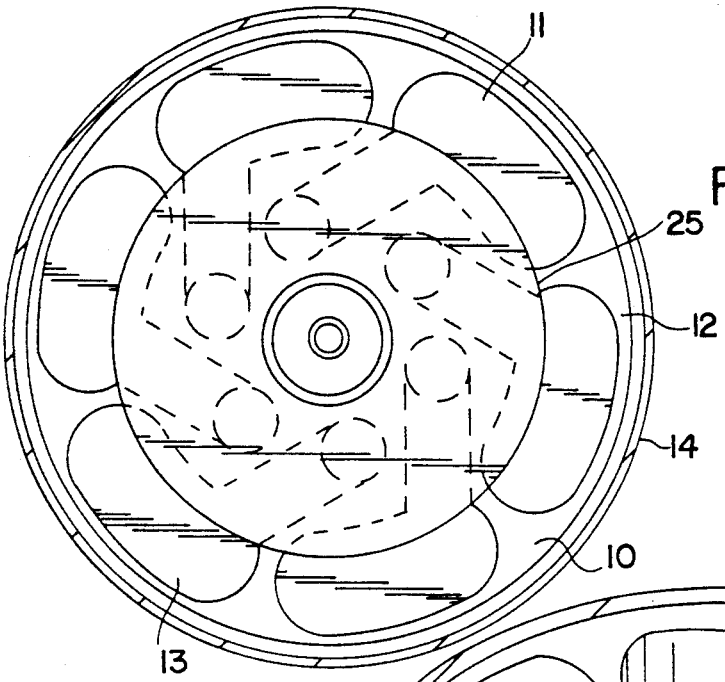
FIG. 3 shows a top view taken along lines 3—3' of a rotary feeding drum of the feeding shown in FIG. 1.
Figure 2:
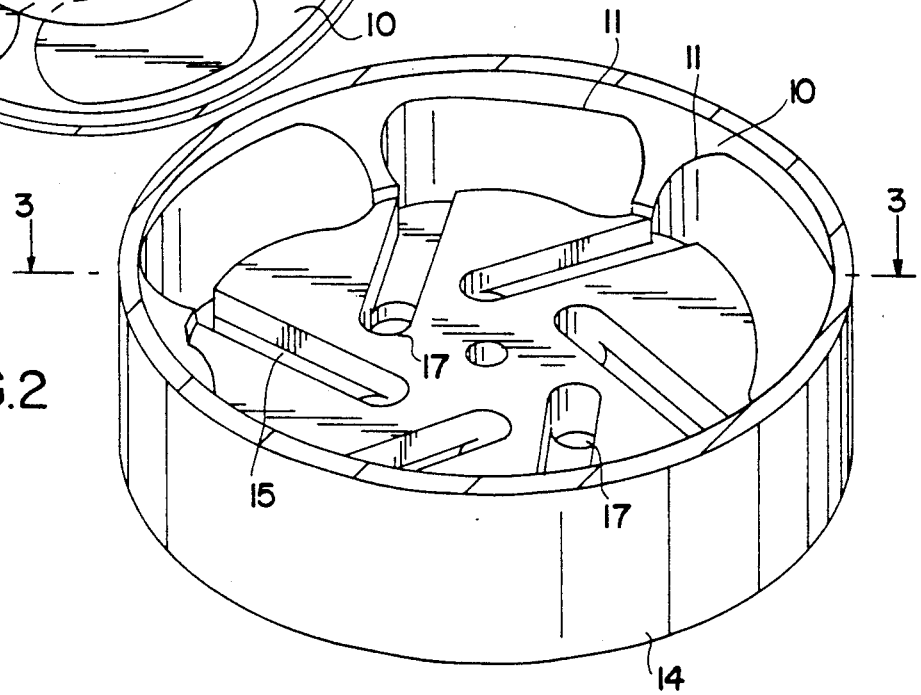
FIG. 2 shows a top perspective view of the rotary feeding drum of the feeding apparatus according to the present invention.

FIGS. 1 through 4A-F illustrate one preferred embodiment of the apparatus for controllably feeding particulate material according to the present invention. As best shown in FIG. 1, the apparatus includes a drum 10 which is rotatably mounted about an axis which is inclined with reference to the horizontal. In the preferred embodiment, the angle of inclination is about 45° with reference to the horizontal A. However, different inclination angles could be selected from about 30° to about 60°. The drum 10 includes a bottom wall 12 and an upstanding side annular wall 14. In the preferred embodiment, as best shown in FIGS. 2 and 3, a plurality of identical cavities 11 are provided substantially in the inner surface of the bottom wall 12 of the drum 10. In the illustrated embodiment, six such cavities 11 are equally spaced about the periphery of the drum 10.

Each cavity 11 includes a first portion 13 which is partially formed in the inner surface of the side wall 14 and extends in a direction substantially coinciding with the periphery of the drum into the inner surface of the bottom wall 12 of the drum 10. A second portion 15 of each cavity 11 extends from the first portion 13 at one end towards the center of the bottom wall and is positioned generally transversely with respect to the first portion 13. The second portion 15 at the other free end communicates with aperture 17 formed in the bottom wall 12 of the drum 10. In the illustrated preferred embodiment, the first portion of the cavity has a larger volume than the second portion. In the preferred embodiment, each cavity is provided with separate outlet means for discharging the particulate material. However, instead of having a separate aperture for each cavity, a single, common outlet means can be conveniently provided in the central portion of the drum in communication with all of the cavities if the drum is supported and rotated by a means other than the centrally located means shown.

Provision of the plurality of cavities in the bottom wall of the drum for lifting and directing the particular material to the outlet means allows for smoother and more regular feeding of the material and increases the feeding rate accuracy.

The particulate material is fed to the drum through a feeding tube 20. The feeding tube is so positioned with respect to the bottom wall 12 of the drum 10 that the particulate material is fed to any cavity 11 when such cavity is at its lowermost position with respect to the horizontal and preferably is fed at the location of the above-described first portion of such cavity.

Various other lifting shapes for the cavities may be used. Also, other configurations of cavities in the bottom wall of the drum may be provided. For example, the discharge apertures in the cavities may be positioned at the portion of the cavity adjacent the periphery of the drum's bottom wall instead of adjacent the drum's center. For such configuration, the feeding tube is positioned to feed each cavity while it is substantially at its highest position with respect to the horizontal rather than at its lower position as in the disclosed embodiment and directs the material to that portion of each cavity which is generally toward the central portion of the drum and thus removed from the location of the aperture, and the material then flows by gravity to each cavity's outlet when the respective cavity is rotated toward its lower position relative to the horizontal.

The feeding apparatus is provided with means for blocking the flow of the particulate material from feeding tube 20 to the cavity being filled. This is accomplished by terminating the end 22 of the feeding tube 20 at a predetermined distance (i.e. one quarter inch or so in 2 specific embodiments) above the tops of the cavities 11 so that movement of the particulate material from the feeding tube 20 becomes blocked and interrupted by previously deposited particulate material when the level of the material over the cavity reaches a predetermined level.

Preferably, the diameter of the feeding tube 20, and all other parameters associated with the rate of material fed by the tube, are so selected that they do not constitute a limiting factor on the rate at which material is fed to the cavities. That is to say that for the maximum desired rate of feeding of the material, the feeding tube is intended to supply the material at that rate, and such rate is sufficient to fill each cavity to its maximum intended capacity at the highest expected rate of drum rotation. For lower drum rotation rates, corresponding to lower feed rates, excess supply of the material to the drum cavities is prevented by the blocking of the outlet end of the feed tube. The feed rate thus obtained is a function of substantially only the rate of drum rotation and the size and number of cavities; variables that are easy to control. This constitutes a distinct advantage over the previously mentioned belt-type feeders in which the material is fed from a feed tube onto a moving belt. In this method, the feed rate is not only dependent on belt velocity but also substantially on the distance between the belt and the end of the feed tube; a variable that, dependent on the physical character of the particulate material, can have a limited and critical useful range and can also be difficult to optimize and control under some conditions.

Figure 7:
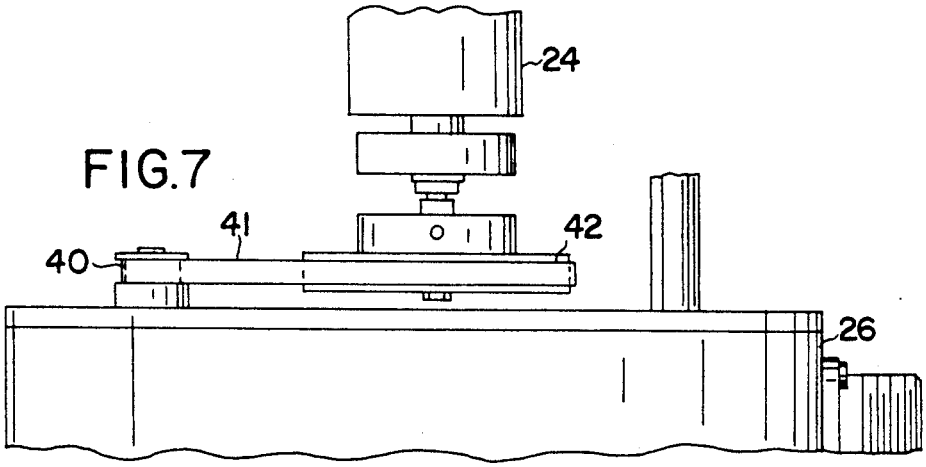
FIG. 7 shows, in detail, power transmitting means between driving means and the rotary drum.

The drum 10 is rotatably mounted on a shaft 19 coupled through rotatably supportive and vacuum sealing means 24 to a driving means 26 for rotating the drum 10 at a preselected rotary speed. The driving means includes a variable speed electrical motor which is controlled by signals from a motor control unit 26. FIG. 7 shows in greater detail power transmission means including a motor pulley 40, a drum pulley 42 and a belt 41.

The feeding apparatus further includes a funnel 23 which surrounds the drum 10. The enlarged portion 21 of the funnel 23 is coaxial with the drum, mounted about the shaft 19 and supported at the top by means 27 and at the bottom by means 29 within a housing 30. A feeding tube 20 which extends through an opening in the housing 30 and into the drum 10 has an end 22 which is horizontally and vertically, adjustably mounted. The position of its free end 22 above the cavities 11 formed in the bottom wall 12 of the drum 10 may be controlled by the operation of one or more of three equally spaced spring loaded bolts 28. The particulate material discharged from the aperture 17 in the bottom wall 12 of the rotary drum 10 falls into the funnel 23. Means 34 are provided to direct the flow of the particulate material supplied to the funnel into a discharge outlet 36 provided in communication with the part of the enlarged portion 21 of the funnel 23 which is in the lowest position with respect to the horizontal.

Also, means are provided to ensure filling of the first portion 13 of the cavities 11 with particulate material without any substantial filling of the material fed from the tube into the second portion 15 of the cavities 11. In the preferred embodiment, this is accomplished by provision of a circular plate 25 which is mounted about the shaft 19 and is dimensioned to cover at least a part of the first portion 13 and all of the second portion 15 of the cavities 11.

Figure 4A:
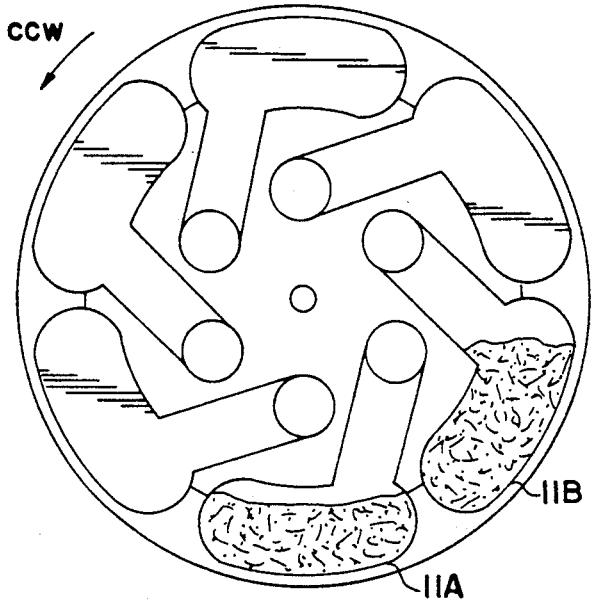
FIGS. 4A, 4B and 4C show a feeding drum at different rotational positions to illustrate its operation.
Figure 4B:
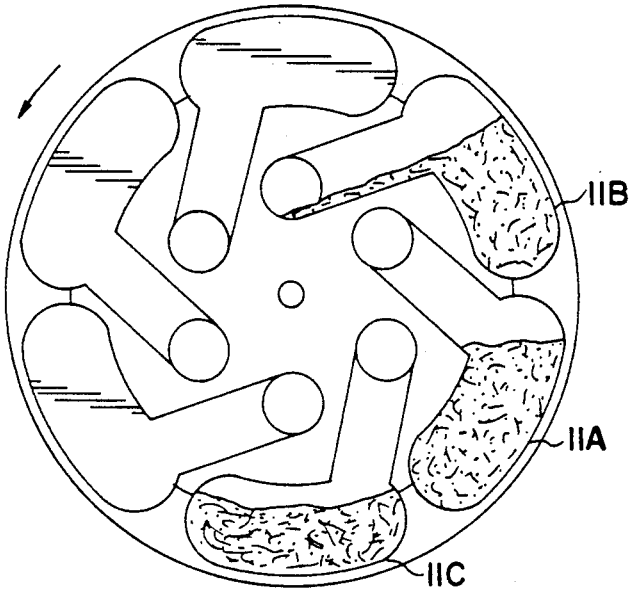
Figure 4C:
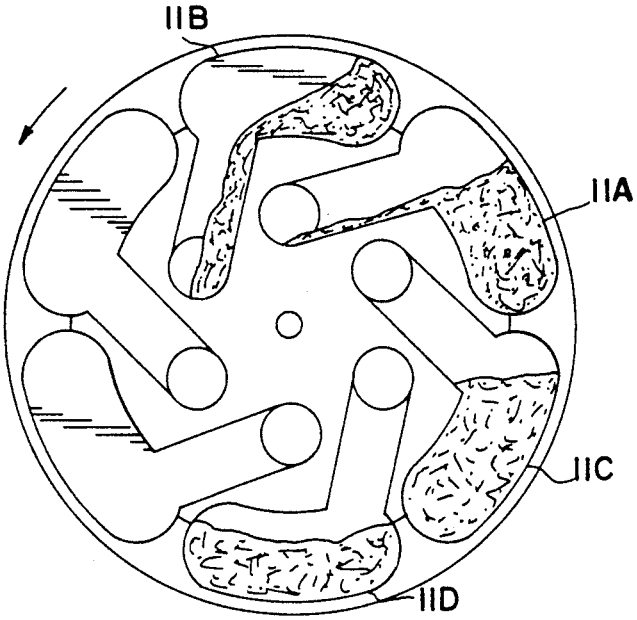

The operation of the present invention feeding apparatus is best illustrated in FIGS. 4A–4C which show the rotary drum in three different angular positions with reference to the horizontal A as it is rotating counterclockwise.

In FIG. 4A, the cavity designated as 11A is in its lowest position with respect to the horizontal, and is being filled with the particulate material supplied from feeding tube 20. The first portion 13 of the cavity 11A is shown as filled with the particulate material, whereas the second portion 15 is empty. The cavity designated as 11B, which is in a higher position with respect to the horizontal than 11A and is in a counterclockwise direction from cavity 11A, has its first portion 13 partially emptied of some of the particulate material which has entered into the second transverse portion 15 of the cavity 11B at this angular position of the drum.

In FIG. 4B, cavity 11C is in its lowermost position with respect to the horizontal and the first portion 13 of the cavity 11C is being filled with the particulate material to the predetermined level whereas in cavity 11A, a part of the particulate material has moved from the first portion 13 into the second portion 15 of the cavity. The particulate material in cavity 11B at this angular position of the drum with respect to the horizontal begins to fall, due to gravitational forces, from the second portion 15 of the cavity 11B into and through aperture 17 at its end and is being discharged from the drum.

Figure 4F:
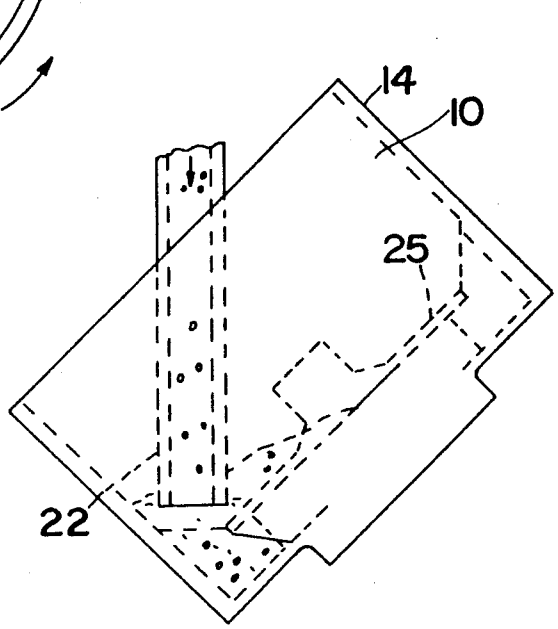
FIGS. 4D, 4E and 4F illustrate the function of a circular plate.
Figure 4E:
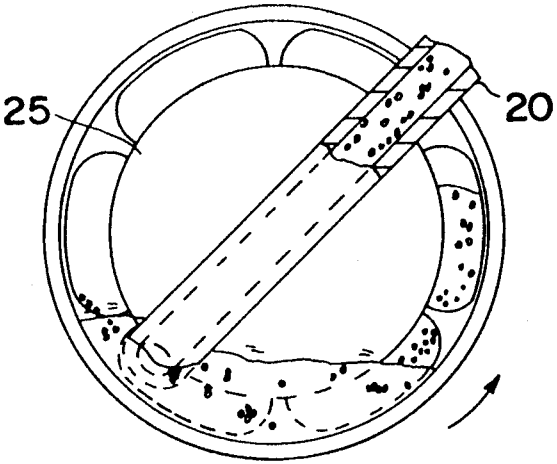
Figure 4D:
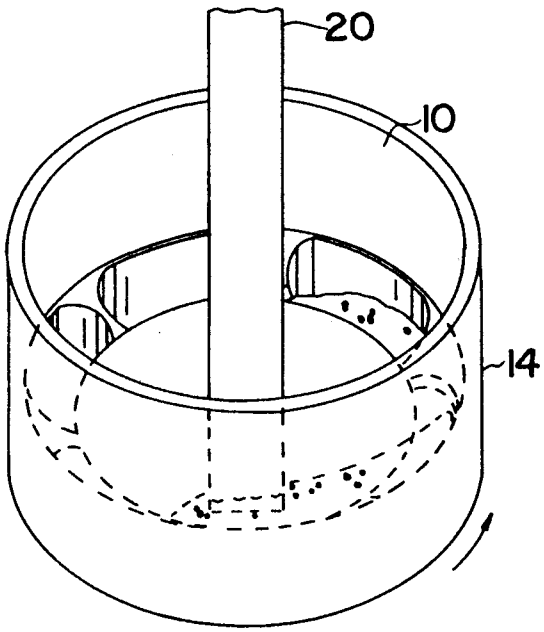

In FIG. 4C, the particulate material in cavity 11B is almost fully discharged, whereas cavity 11D is now in its lowermost position and is fed with the particulate material supplied by the feeding tube. The feeding rate of the particulate material being discharged through the apertures communicating with each cavity is controlled substantially by the rate of rotation of the drum for a given size and shape of the cavities 11 and to the extent to which circular plate 25 covers a portion of cavities 11 and the angle to the horizontal of drum 10. FIGS. 4D–4F illustrate more clearly the important function of circular plate 25. The particulate material actually rides about halfway up the leading counterclockwise side of the drum and forms a continuously avalanching "hill" of material. The circular plate prevents material from this hill from falling directly into second cavity portion 15 and through aperture 17. Only material still in the cavity first portion 13 and to a lesser extent cavity second portion 15, that emerges above the top of the hill, will be transferred to drum aperture 17.

In a preferred embodiment, the repeatable feed rates are between 25 g and 500 g/minute. The structure of the drum and the fact that each cavity 11 completely empties during each drum revolution prevents material segregation. This basic design allows for feeding of particulate material having various sizes limited only by the dimensions and shapes of the cavities and apertures.

Figure 5:
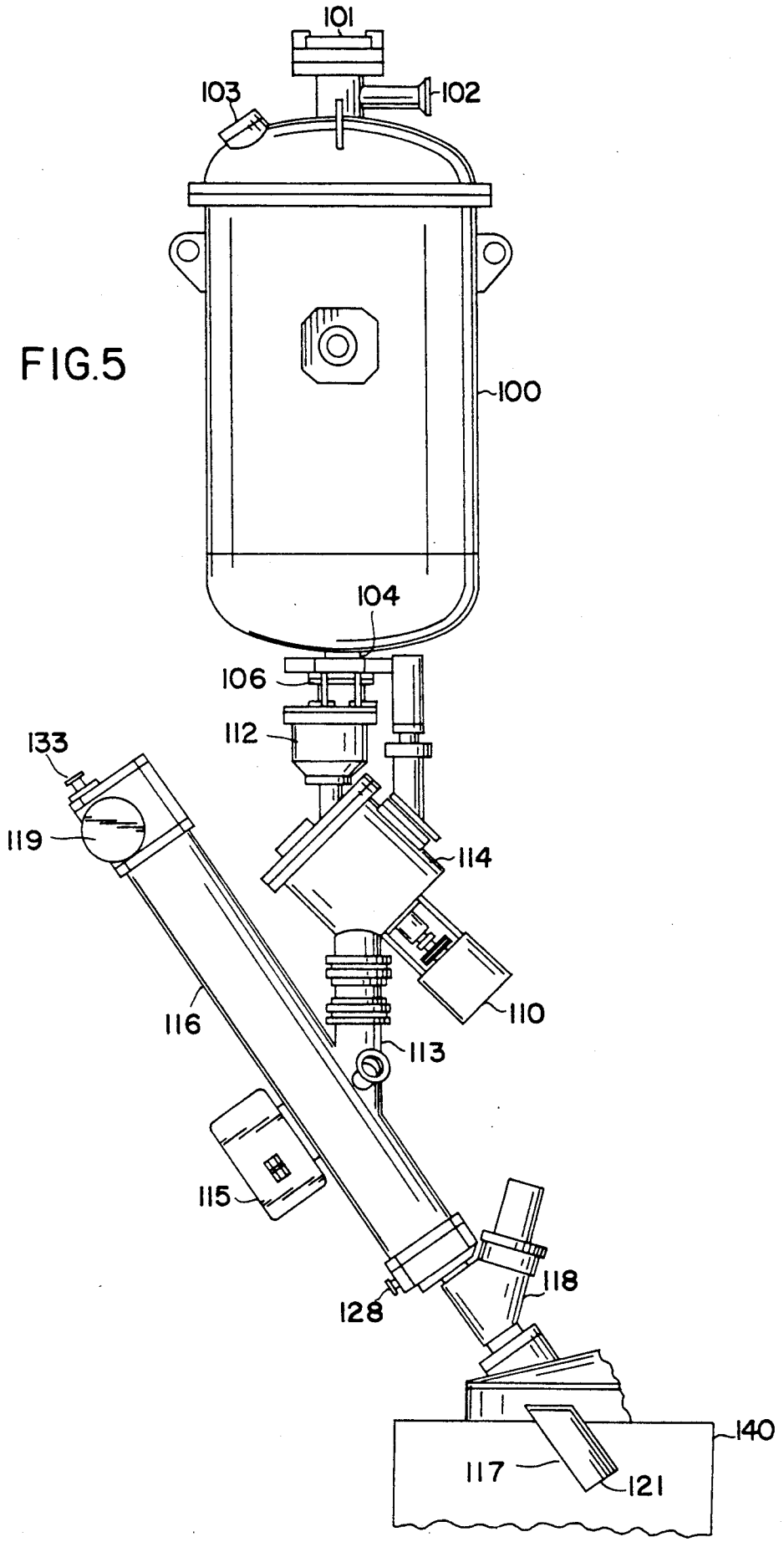
FIG. 5 shows a silicon replenishment apparatus for a crystal grower incorporating the feeding apparatus of FIG. 1.

FIG. 5 shows one particularly suitable application of the present invention feeding apparatus as a silicon feeder mechanism for a silicon crystal growing furnace. The silicon feeder mechanism is used to feed granular silicon material at a known and controllable rate into the crucible of a silicon crystal grower furnace for the purpose of initially charging or replenishing material used after growing a crystal. A further possible use may be to continuously feed material to the crucible while the crystal is growing. This apparatus is adapted for controllable, accurate feeding with minimal contamination of the silicon material.

In the apparatus shown in FIG. 5, the silicon material is supplied into a storage container 100 through a silicon refill port 101. The storage container 100 also includes an argon/vacuum connection inlet 102 and a view port 103 for visual inspection of the silicon material content in the storage container 100. The outlet 104 of the storage container 100 is connected through a disconnecting means 106 to a feeding tube housing 112 which forms a part of the apparatus for controllable feeding 114 which has structural features disclosed above in connection with the description of FIGS. 1–4. Feeding tube housing 112 containing feeding tube 20 supplies silicon material to the tilled rotary drum of the apparatus 114. The feeding rate at which the silicon material is being discharged from the drum is controlled by the rate of rotation of the tilted drum by the drum driving means 110. The rate of rotation of the drum driving means 110 is selected based on the conditions in the crucible. Predetermined parameters, such as total silicon weight and melt-down rate, and real-time parameters, such as temperature and visual indications, are typical considerations. Based on this information delivered from the furnace 140 to the computer unit (not shown), appropriate feeding rates are also selected by the computer unit and output signals are sent to the input of the electronic controls of the drum driving means 110.

The tilted drum and associated feeding tube, collection funnel and motor drive have been designed to allow a predictable and controllable silicon material feed rate. The silicon feeding rate is very important in this application, since it must be matched to the furnace material meltdown rate capability. Additionally, known feeding rates are required in order to calculate the total amount of silicon material supplied to the crucible.

Figure 6:
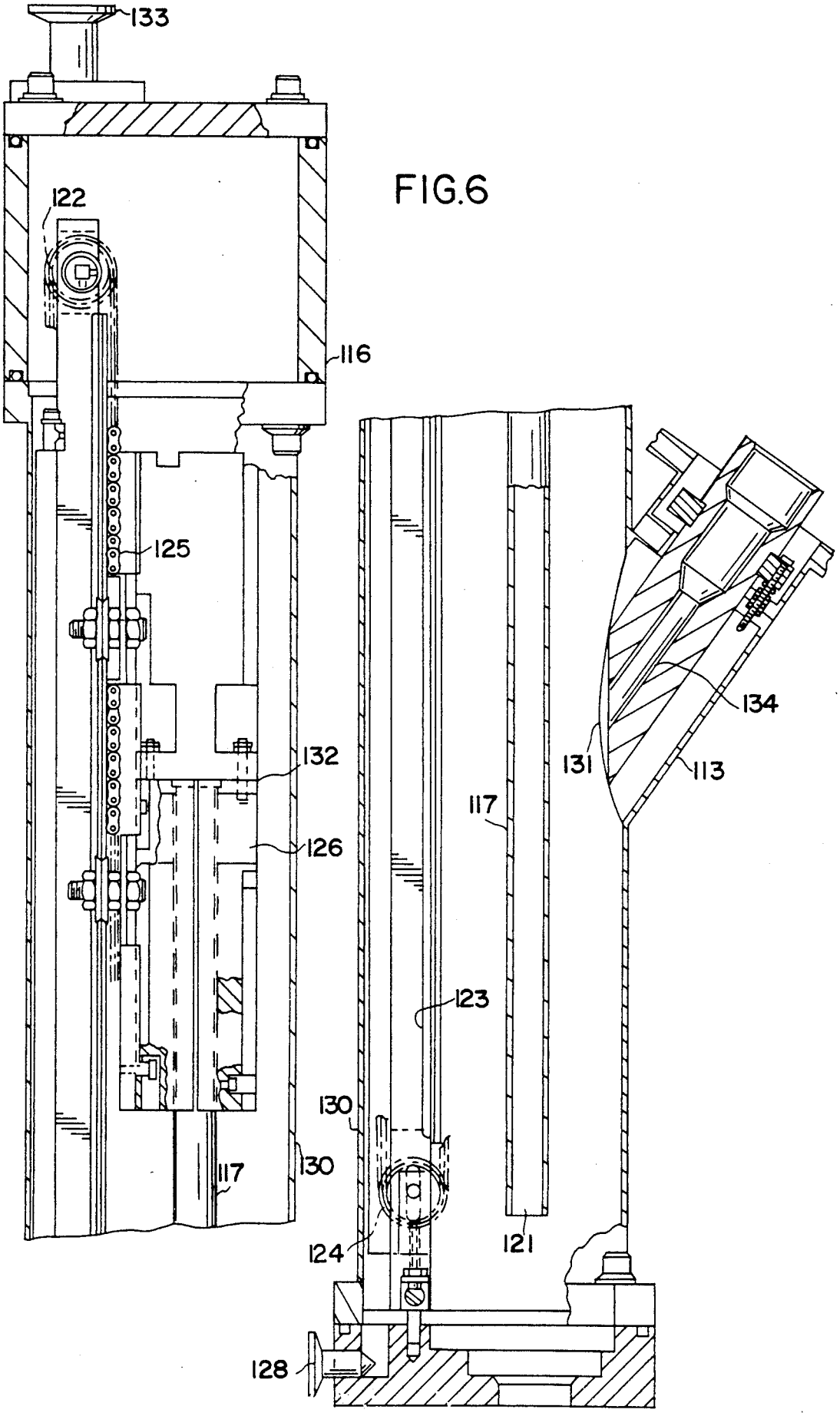
FIG. 6 shows, in more detail, an injector device of the apparatus of FIG. 5.

The silicon material discharged from the apparatus for controllable feeding 114 is delivered through discharge housing 113 containing discharge tube 134 at a preselected rate to injection means 116. The injection means is shown in more detail in FIG. 6. Injection means 116 includes retractable injector tube 117 extendable into the furnace 140 for supplying the silicon material into the crucible. The injection means 116 includes a housing 130 into which enters a discharge end 131 of the tube 134. Inside the housing a retractable injector tube 117 is movable between an extended position in which its discharge forward end 121 is positioned inside the furnace 140 and a retracted position in which the injector tube 117 is positioned inside the housing 130. The injector tube 117 is movably supported in the housing 130 by an injector tube support 132 and drive track rail 123 means. A drive chain 125 extends between two spaced apart chain support sprockets 122, 124. Drive chain 125 follows drive track rail 123 while pulling the injector tube 117 in the injector tube support means 132.

As shown in FIG. 5, the injecting means 116 also includes driving means 119 for injector tube 117 and electronic controls 115 for controlling driving means 119. At the ends of the injecting means 116 argon/vacuum connection inlets 128 and 133 are provided. Also, vacuum isolation valve 118 is provided between the injecting means 116 and the furnace 140. In the preferred embodiment, the electronic controls for the injecting means 115 are designed to enable beginning of rotation of the drum by computer control only when the injector tube 117 is in a particular position with respect to discharge tube 134. In such position, the inlet 126 of the injector tube 117 for receiving silicon material from the discharge tube 134 is aligned with the outlet opening 131 in the tube 134. This electronic position interlock prevents silicon material from spilling into housing 130 due to inadvertent rate input control to motor control unit 110.

In this particular application, all materials in contact with the silicon material must be compatible with silicon handling and non-contaminating. Such materials may include tefzel for storage tank coating, teflon for delivering tubes and the drum, quartz for funnels and the feeding tube. Sizing of the various housings and the design of the internal components provides for future use of silicon as a construction material for many of the silicon handling parts.

The present invention for controllable feeding of material to a crystal growing furnace is very useful since it allows for a more accurate feeding rate, eliminates spilling of the material, and allows for use of a very simple drum structure which requires little maintenance and can be made from a variety of rigid materials.

Although the principles of the present invention have been described with reference to a particular embodiment, by way of example, it is understood that modifications may suggest themselves to those skilled in the art and it is intended that such modifications fall within the scope of the claims.

What is claimed is:

1. Apparatus for replenishment of a silicon material in a crucible of a crystal growing furnace, comprising:

means for injecting said silicon material into said crystal growing furnace;

means for controlling the feeding rate of said silicon material, said feeding rate being determined by detected conditions in said crucible;

said means for controlling the feeding rate including: a drum mounted for rotation about an axis tilted at an acute angle with reference to a horizontal axis, said drum including a bottom wall having an inner surface, an outer periphery and a center and an annular, upstanding wall;

at least one cavity, at least a portion of which is formed in the inner surface of said bottom wall, said cavity extending from about the outer periphery of said bottom wall at one end and towards the center thereof at an other end;

said cavity at one of its said ends communicating with at least one outlet means means for storing said silicon material located at a position elevated above said cavity;

means for supplying said particulate material from said storing means into said at least one cavity, said supplying means having an outlet port for said material, said supplying means being so positioned in relation to the drum that said outlet port directs the material into the cavity only when said cavity is in a rotational position in which its end having said outlet means is elevated with respect to a horizontal plane above the opposite end of the same cavity, said supplying means being also so positioned that its said outlet end pours the material into that portion of the receiving cavity which is remote from the outlet means for such receiving cavity;

means for blocking the flow of said particulate material to said cavity when the level of said particulate material above said cavity reaches a predetermined level;

means for rotating said drum about said tilted axis; and means for controlling the rate of rotation of said drum;

whereby upon rotation of said drum, said at least one cavity is being filled with said particulate material fed from said supplying means during the rotation of said drum through a first angular portion of its rotation when said outlet means for said cavity is disposed above the already filled portion of the cavity and is emptied to discharge said material through said at least one outlet means by gravitational force during the rotation of said drum through a second angular portion of its rotation when said outlet means for the cavity is below the said filled portion of the cavity, the feeding rate of said material being discharged through said outlet means being controlled by the rate of rotation of said drum; and means for receiving material from said outlet means of said drum, and supplying said material at said selected feeding rate to said injecting means which communicates with said crystal growing furnace for delivering said silicon material into said crucible.

2. Apparatus according to claim 1, wherein said injecting means includes a retractable injector tube which is movable between an extended position in which the forward end of said tube enters into the furnace and in a retracted position in which said end is outside the furnace.

3. Apparatus according to claim 2, wherein rotation of said drum is enabled only in said extended portion of said injector tube.

4. Apparatus according to claim 1, wherein said drum is tilted at an angle of about 45° with respect to the horizontal.

5. Apparatus according to claim 1, wherein said drum is tilted at an angle selected from the range of about 30° to about 60°.

6. Apparatus according to claim 1, comprising a plurality of cavities provided substantially in said bottom wall and equally spaced along the periphery of said bottom wall.

7. Apparatus according to claim 6, wherein each of said cavities comprises a first portion extending at least substantially along the periphery of said bottom wall and a second portion extending from said first portion at one end and towards the center of said bottom wall at the other end and transversely with respect to said first portion.

8. Apparatus according to claim 7, further comprising a circular plate provided in said drum and adapted to cover at least a part of said first portions and all of said second portions of said cavities to eliminate said particulate material supplied from said means for supplying said material from moving into said second portions of said cavities while said cavities are in the lowermost position.

9. A method for controllably feeding a particulate material, comprising the steps of:

supplying said particulate material from a supplying means into a drum mounted for rotation about an axis tilted at an acute angle with reference to a horizontal axis by pouring said material into at least one cavity at least a portion of which is formed in an inner surface of a bottom wall of said 8 drum and extends from about an outer periphery of the bottom wall at one end towards a center of the bottom wall at the other end, one of said end being in communication with an outlet means provided in the bottom wall, said supplying means being so positioned in relation to the drum that said outlet port directs the material into the cavity only when said cavity is in a rotational position in which its end having said outlet means is elevated with respect to a horizontal plane above the opposite end of the same cavity, said supplying means being also so positioned that its said outlet end pours the material into that portion of the receiving cavity which is remote from the outlet means for such receiving cavity;

simultaneously with supplying said particulate material rotating said drum at a predetermined, controllable rate;

filling said at least one cavity with said particulate material during rotation of said drum through a first angular distance;

blocking the flow of said particulate material to said cavity when the level of said particulate material in said cavity reaches a predetermined level;

emptying said cavity by discharging said particulate material through said outlet means, said emptying occurring during rotation of said drum through a second angular distance by gravitational flow of said particulate material; and wherein the rate of discharge of said material is controlled by the rate of rotation of said drum.

10. Apparatus for controllably feeding a particulate material, comprising: a drum mounted for rotation about an axis tilted at an acute angle with reference to a horizontal axis, said drum including a bottom wall having an inner surface, an outer periphery and a center and an annular, upstanding wall;

at least one cavity, at least a portion of which is formed in the inner surface of said bottom wall, said cavity extending from about the outer periphery of said bottom wall at its one end and towards the center thereof at its other end;

said cavity at one of its said ends communicating with at least one outlet means;

means for supplying said particulate material into said at least one cavity, said supplying means having an outlet port for said material, said supplying means being so positioned in relation to the drum that said outlet port directs the material into the cavity only when said cavity is in a rotational position in which its end having said outlet means is elevated with respect to a horizontal plane above the opposite end of the same cavity, said supplying means being also so positioned that its said outlet end pours the material into that portion of the receiving cavity which is remote from the outlet means for such receiving cavity;

means for blocking the flow of said particulate material to said cavity when the level of said particulate material above said cavity reaches a predetermined level;

means for rotating said drum about said tilted axis; and means for controlling the rate of rotation of said drum;

whereby upon rotation of said drum, said at least one cavity is filled with said particulate material fed from said supplying means during the rotation of said drum through a first angular portion of its rotation when said outlet means for said cavity is disposed above the already filled portion of the cavity and is emptied to discharge said material through said at least one outlet means by gravitational force during the rotation of said drum through a second angular portion of its rotation when said outlet means for the cavity is below the said filled portion of the cavity, the feeding rate of said material being discharged through said outlet means being controlled by the rate of rotation of said drum.

11. Apparatus according to claim 10, comprising a plurality of cavities provided substantially in said bottom wall and equally spaced along the periphery of said bottom wall.

12. Apparatus according to claim 11, wherein each of said cavities comprises a first portion extending at least substantially along the periphery of said bottom wall and a second portion extending from said first portion at one end and towards the center of said bottom wall at the other end and transversely with respect to said first portion.

13. Apparatus according to claim 12, wherein said outlet means includes a plurality of apertures, one of said apertures being positioned at the other end of said second portion of each of said cavities.

14. Apparatus according to claim 13, wherein said particulate material is fed only to the particular cavity which is in its lowest position with respect to the horizontal plane.

15. Apparatus according to claim 12, further comprising a circular plate provided in said drum and substantially adapted to cover at least a part of said first portions and all of said second portions of said cavities to eliminate said particulate material supplied from said means for supplying said material from moving into said second portions of said cavities while said cavities are in the lowermost position.

16. Apparatus according to claim 10, wherein said drum is tilted at an angle of about 45° with respect to the horizontal.

17. Apparatus according to claim 10, wherein said drum is tilted at an angle selected from the range of about 30° to about 60°.

18. Apparatus according to claim 10, wherein said means for supplying said particulate material includes a feeding tube.

19. Apparatus according to claim 18, wherein said material blocking means includes the free end of said feeding tube positioned above said cavity at such a distance that the flow of said particulate material into said cavity is interrupted when the level of said particulate material in said cavity reaches a predetermined level.

20. Apparatus according to claim 12, wherein said first portion of said cavity has a larger volume than said second portion.

21. Apparatus according to claim 19, wherein said predetermined level is approximately the end of said feeding tube.

22. Apparatus according to claim 12, wherein said particulate material is fed only to said first portion of that cavity which is at the lowest position with respect to the horizontal plane.

* * * * *